US005341198A

United States Patent [19]

Pawlik et al.

[11] Patent Number: 5,341,198

[45] Date of Patent: Aug. 23, 1994

[54] APPARATUS FOR SEALING A METERING ROLL

[75] Inventors: Robert S. Pawlik, Webster; Robert E. Gary, Ontario, both of N.Y.

[73] Assignee: Xerox Corporation, Stamford, Conn.

[21] Appl. No.: 936,401

[22] Filed: Aug. 31, 1992

[51] Int. Cl.[5] ..... G03G 15/20

[52] U.S. Cl. ..... 355/284; 118/60; 277/12; 277/DIG. 7

[58] Field of Search ..... 355/282, 283, 284, 293; 118/60; 277/12, DIG. 7

[56] References Cited

U.S. PATENT DOCUMENTS

| | | | |
|---|---|---|---|
| 4,026,238 | 5/1977 | Bar-on | 118/60 |
| 4,055,143 | 10/1977 | Hattler et al. | 118/60 |
| 4,426,953 | 1/1984 | Kromm et al. | 118/60 |
| 5,142,122 | 8/1992 | Ariyama | 355/284 X |
| 5,202,734 | 4/1993 | Pawlik et al. | 355/284 |

FOREIGN PATENT DOCUMENTS

| | | | |
|---|---|---|---|
| 52-26836 | 2/1977 | Japan | 355/284 |
| 63-217389 | 9/1988 | Japan | 355/284 |

*Primary Examiner*—Fred L. Braun

*Attorney, Agent, or Firm*—Finnegan, Henderson, Farabow, Garrett & Dunner

[57] ABSTRACT

An end sealed metering apparatus includes a cylindrical metering roll mounted for rotation about a central longitudinal axis, a blade aligned with the longitudinal axis and contacting the metering roll, an elastomeric seal supported against an end of the metering roll, a rigid plate coupled with the elastomeric seal for holding the elastomeric seal stationary while the metering roll rotates, and a spring for urging the rigid plate and elastomeric seal against the end of the metering roll.

21 Claims, 3 Drawing Sheets

APPARATUS FOR SEALING A METERING ROLL

BACKGROUND OF THE INVENTION

Field of the Invention

The invention relates generally to electrophotographic apparatus, and, more particularly, to an end sealed metering roll assembly for eliminating excessive oil concentrations transferred to a fuser roll.

Description of the Related Art

The basic xerographic process comprises exposing a charged photoconductive member to a light image of an original document. The irradiated areas of the photoconductive surface are discharged to record thereon an electrostatic latent image corresponding to the original document. A development system moves a developer mix of carrier granules and toner particles into contact with the photoconductor surface. The toner particles are attracted electrostatically from the carrier granules to the latent image, forming a toner powder image. The toner powder image is then transferred to a sheet of paper or other support material. This sheet of paper advances to a fuser roll which permanently affixes the toner powder image to the paper.

In order to function properly, the rolling cylindrical or peripheral surface on the fuser requires application of a layer of lubricant for lubrication. Many copiers, such as the Model Nos. 1065 and 5090 copiers, manufactured by Xerox Corporation, contain a release agent management system for performing this function. The release agent management system generally includes a metering roll, a metering blade, a donor roll, and an oil applicator. The system operates by rotating the metering roll in conjunction with the donor roll so that as the metering roll rotates, the oil applicator applies oil to the peripheral surface of the metering roll where it is distributed evenly about peripheral surface by the metering blade. The peripheral surface of the metering roll contacts the surface of the donor roll to transfer oil from the metering roll to the peripheral surface of the donor roll. The donor roll also contacts the peripheral surface of the fuser roll to transfer oil to, and thus lubricate, the fuser roll.

Due to insufficient space in the copier above the metering roll, the metering blade is generally positioned below the metering roll. As a result, when the metering roll stops rotating, any oil that is on the metering roll between the metering blade and the peripheral surface of the metering roll will flow to the top side of the blade due to gravity and create an excess oil accumulation. This excess oil accumulation is transferred to the fuser roll when the metering roll is subsequently rotated. The excess oil is then transferred to copies passing through the fuser assembly, creating undesirable marks on the copies.

Undesirable marks on the copies are most pronounced on the sides of the copies due to excessive oil accumulation at the ends of the metering roll and the metering blade. This excess oil at the ends of the metering roll and metering blade is caused by two separate problems in the design of the metering roll assembly. First, as the metering roll rotates, there is a self-pumping action which forces oil to the ends and side edges of the metering roll. Since there is nothing to prevent this self-pumping action, when the metering roll stops rotating, the excess oil which has been pumped to the ends and side edges of the metering roll will accumulate on the ends of the metering blade, which is generally longer than the metering roll.

Second, bending forces applied to the metering blade cause the ends of the metering blade to bend away from, and thus separate, from the surface of the metering roll. As a result, oil accumulating at the ends of the metering roll is not evenly distributed by the metering blade. This excess oil then accumulates on the metering blade when the metering roll stops rotating.

The combination of the excess oil due to the self-pumping action of the metering roll and the separation of the ends of the metering blade from the metering roll forms an excess oil accumulation at the ends of the metering blade and roll which is subsequently passed to the fuser assembly and onto copies. As a result, an undesirable copy quality defect, known as a "oil wing", is formed on the copies as they pass through the nip between the fuser and the pressure roll.

SUMMARY OF THE INVENTION

Accordingly, it is an object of the present invention to provide a metering apparatus which does not create copy quality defects on paper passing through the nip between a fuser roll and a pressure roll.

It is another object of the invention to provide such a metering apparatus having a metering blade and which prevents excess oil from accumulating on the metering blade.

A further object of the invention is to provide such a metering apparatus which controls self-pumping action of oil toward the ends of a metering roll.

A still further object of the invention is to provide a metering apparatus which eliminates excess oil from accumulating at the ends of a metering blade due to separation between the ends of the metering blade and a peripheral surface of a metering roll.

Additional objects and advantages of the invention will be set forth in the description which follows and in part will be obvious from the description, or may be learned by practice of the invention. The objects and advantages of the invention may be realized and attained by means of the instrumentalities and combinations, particularly pointed out in the appended claims.

To achieve the objects and in accordance with the purpose of the invention, as embodied and broadly described herein, there is provided a lubricant metering apparatus, comprising a metering roll rotatably mounted on a shaft, a blade aligned along a longitudinal axis of the metering roll, means for supporting the blade so that an edge of the blade contacts a peripheral surface of the metering roll, sealing means supported against an end of the metering roll for preventing excess lubricant from accumulating at the end of the metering roll, and means for supporting the sealing means against the end of the metering roll.

DETAILED DESCRIPTION OF THE PREFERRED EMBODIMENTS

Figure 1:
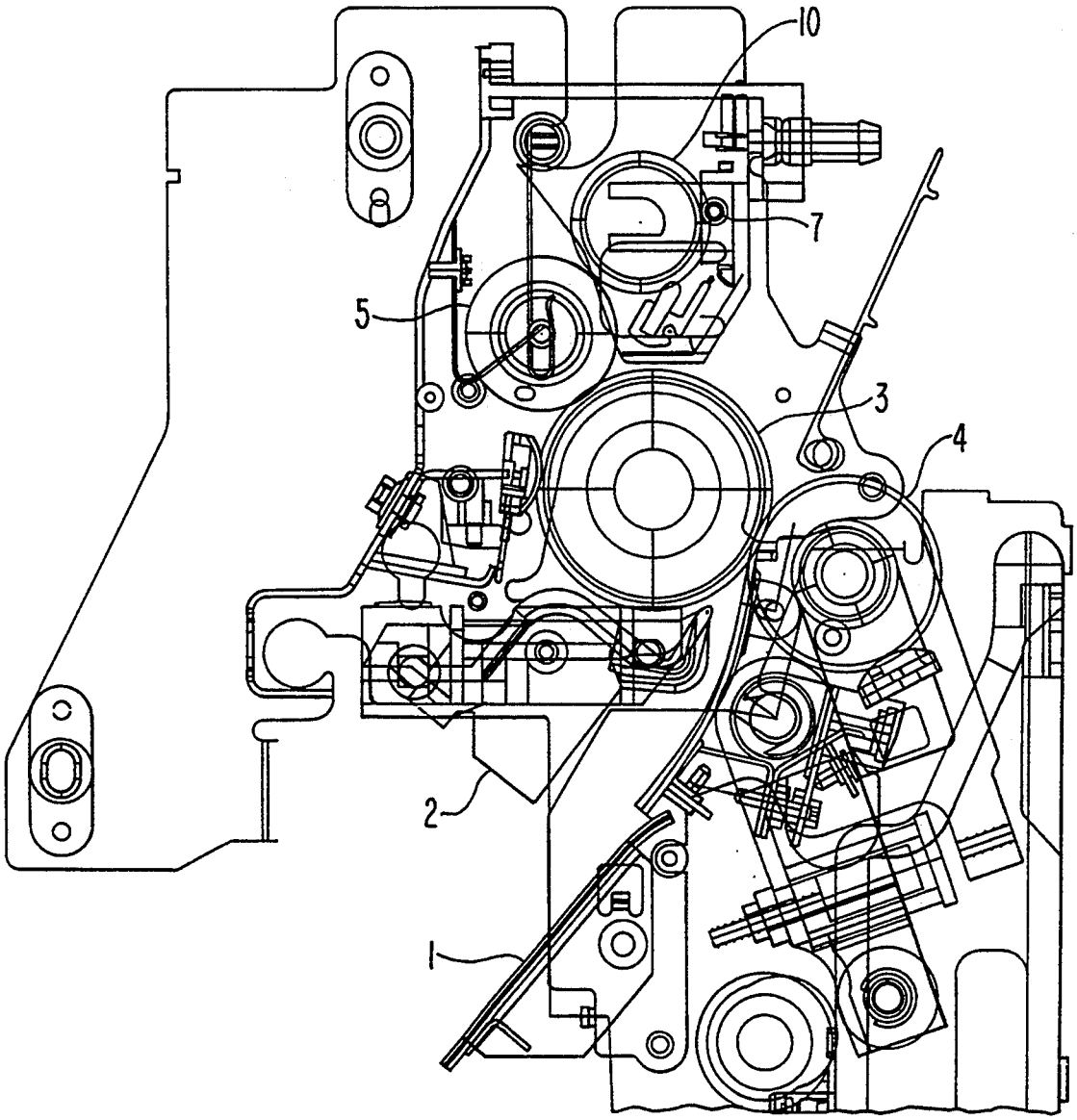
FIG. 1 is a largely schematic side elevation of a metering roll assembly embodied in an electrophotographic apparatus.

FIG. 1 shows a metering roll assembly embodied in an electrophotographic apparatus, such as the Model No. 5775 copier manufactured by Xerox Corporation.

A sheet of paper follows a paper path 1 along which a photoreceptor 2 affixes a toner powder image to the paper corresponding to an original document. The sheet of paper carrying the toner powder image then passes through a nip between a fuser roll 3 and a pressure roll 4 to permanently affix the toner powder image to the paper.

To lubricate the fuser roll 3, an oil applicator 7 applies a layer of oil to a metering roll 10. The oil is evenly distributed on the peripheral surface of the metering roll 10 by a metering blade 11. The metering roll 10 then transfers the oil to the peripheral surface of a donor roll 5 which, in turn, transfers the oil to the peripheral surface of the fuser roll 3.

Rotation of the metering roll 10 is controlled by the rotation of the fuser roll 3. A drive mechanism (not shown) is provided for rotating the fuser roll 3. Since the fuser roll 3 is in rolling contact with the peripheral surface of the donor roll 5, rotation of the fuser roll 3 also causes the donor roll 5 to rotate by friction. Similarly, since the donor roll is in rolling contact with the metering roll 10, friction between the peripheral surface of the metering roll 10 and the peripheral surface of the donor roll 5 causes the metering roll 10 to rotate with the donor roll 5 and fuser roll 3.

Figure 3:
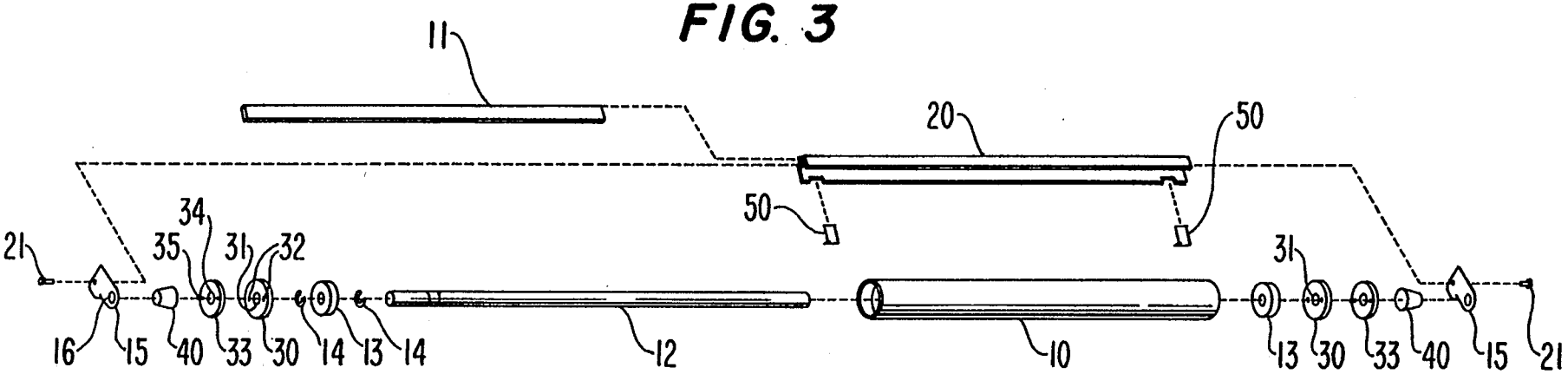
FIG. 3 is an exploded perspective view of the end sealed metering roll apparatus of the present invention.

FIG. 3 shows an exploded view of the metering roll assembly embodiment of the present invention. The metering roll comprises a hollow cylindrical shell 10 rotatable about a shaft 12 disposed within the hollow portion of the cylinder. Bearings 13 are mounted on the shaft within each end of the hollow cylinder and held in place by retaining clips 14. In the illustrated embodiment, the ends of the shaft are supported in non-circular openings 16 formed on support plates 15.

A blade holder 20 is secured to the support plates 15 by screws 21. The blade holder 20 supports an edge of the metering blade 11 so that the opposite edge of the metering blade 11 is in contact with the peripheral surface of the metering roll 10. The metering blade 11 is typically longer than the metering roll and is made of an elastomeric material to reduce wear and better contact the surface of the metering roll 10.

Figure 2:
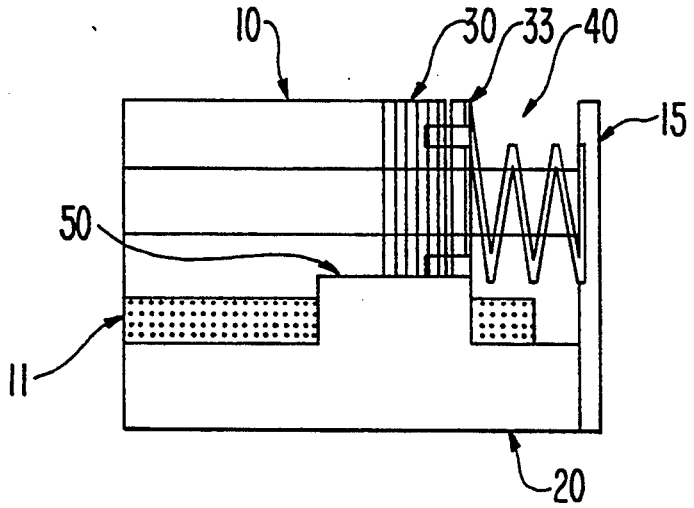
FIG. 2 is a front view of the end sealed metering roll apparatus of the present invention.

Referring to FIGS. 2 and 3, an end seal 30 having a hollow central portion 31 is mounted on the shaft 12 between each end of the metering roll 10 and the support plates 15. The end seal 30 is preferably disk-shaped and preferably having an outside diameter the same as the diameter of the metering roll shell 10. The end seal also has two diametrically spaced axial holes 32. The end seals 30 are made of an elastomeric material to slidably engage and seal with the ends of the metering roll shell 10 without causing wear. A preferred material is compound 65704 Fluorol B, ASTM No. D2000M7HK610 Al-10 B38 Z1.

Rigid force plates 33 having a central circular opening 34 are disposed on the shaft 12 between the support plates 15 and the end seals 30. Each force plate 33 is preferably configured to have approximately the same dimensions as the end seal and is composed of a material of sufficient hardness to firmly hold the end seal 30 against the end of the metering roll 10. Such material may be a polycarbonate. Small protrusions 35 on the surface of the force plate 33 are designed to engage the small holes 32 of the end seal.

Figure 4:
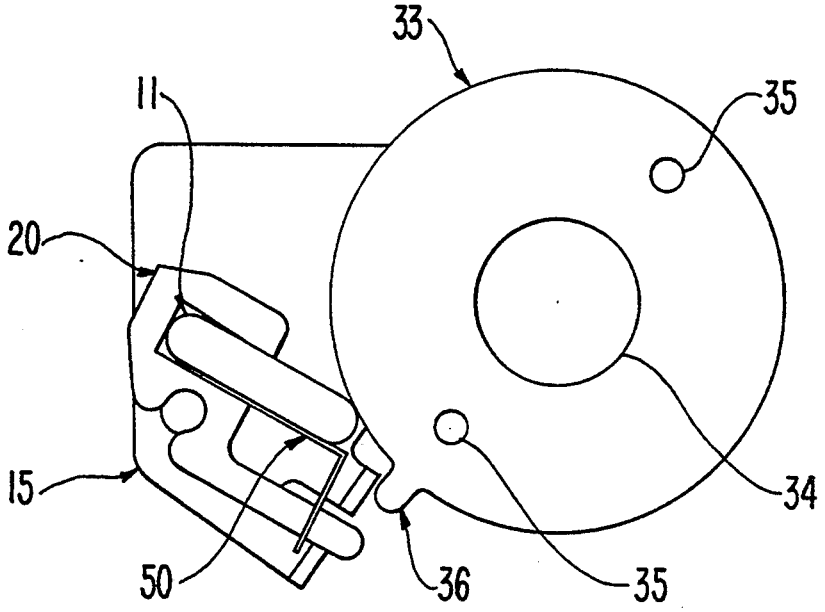
FIG. 4 is a side view of a force plate of the present invention.

As shown in FIG. 4, the force plate 33, which is preferably disk-shaped, has an engaging tang 36 formed on its peripheral surface to contact the blade holder 20. Since the blade holder is stationary, the tang 36 prevents the force plate 33 from rotating with the metering roll 10. Since the force plate 33 is coupled to the end seal 30 by the engagement of the protrusions 35 with the hollow portions 32, the end seal 30 is also prevented from rotating with the metering roll 10.

A spring 40 is mounted on the shaft 12 between the support plate 15 and the force plate 33 to urge the force plate 33 and the end seal 30 against the end of the metering roll 10. A spring force of approximately 0.5 lb is generally sufficient to urge the end seal 30 in sealing contact with the end of the metering roll 10. The necessary force, however, may vary depending on the specific application.

In the preferred embodiment of the invention, means are also provided for urging the ends of the metering blade 11 against the ends of the metering roll 10. The urging means preferably comprises two shims 50 or leaf springs secured to the blade holder 20 near the ends of the metering blade 10. The shims. 50 force the ends of the metering blade 11 against the surface of the metering roll 10 to prevent separation between the metering blade 11 and the metering roll 10 at the ends of the metering roll 10.

In operation, the metering apparatus of the present invention greatly reduces the accumulation of excess oil at the ends of the metering roll, thereby preventing copy quality defects from being formed on the paper copies. The elastomer end seals 30, which are held stationary against the ends of the metering roll 10 while the metering roll 10 is rotating, prevent fluid dynamic forces from pumping fluid toward the ends and side edges of the metering roll 10 since there is no pumping action past the stationary end seals 30. Additionally, the shims 50 urge the ends of the metering blade 11 against the metering roll, thus preventing separation and deterring excess oil from flowing to the ends of the metering blade 11. Therefore, excess oil is prevented from accumulating on the top ends of the blade 11 and copy quality defects are greatly reduced.

It will be apparent to those skilled in the art that various modifications and variations can be made in the present invention without departing from the spirit or scope of the present invention. Thus, it is intended that the present invention cover the modifications and variations of this invention, provided that they come within the scope of the claims.

What is claimed is:

1. A lubricant metering apparatus, comprising:

a cylindrical metering roll supported for rotation about a central longitudinal axis, the metering roll having a peripheral surface and radial end surfaces;

a blade aligned with the longitudinal axis;

means for holding the blade so that an edge of the blade contacts the peripheral surface of the metering roll;

sealing means, supported against at least one of the radial end surfaces of the metering roll, for preventing excess lubricant from accumulating at the end of the metering roll; and means for supporting the sealing means against the one radial end surface of the metering roll.

2. The metering apparatus of claim 1, wherein the supporting means holds the sealing means stationary against the one radial end surface of the metering roll while the metering roll rotates.

3. The metering apparatus of claim 1, wherein the sealing means includes an elastomeric seal.

4. The metering apparatus of claim 3, wherein the elastomeric seal is disk-shaped.

5. The metering apparatus of claim 3, wherein the supporting means includes a rigid plate coupled to the elastomeric seal.

6. The metering apparatus of claim 5, wherein the rigid plate is disk-shaped and has a tang formed on its peripheral surface to engage the blade holding means and prevent rotation of the elastomeric seal.

7. The metering apparatus of claim 5, wherein the supporting means further comprises means for urging the rigid plate against the elastomeric seal to force the elastomeric seal into sealing contact with the one radial end surface of the metering roll.

8. The metering apparatus of claim 7, wherein the urging means comprises a spring.

9. The metering apparatus of claim 1, further comprising means for urging the ends of the blade against the peripheral surface of the metering roll.

10. The metering apparatus of claim 9, wherein the blade urging means are disposed at each end of the blade holding means.

11. The metering apparatus of claim 10, wherein the blade urging means comprises at least two springs.

12. The metering apparatus of claim 10, wherein the blade urging means comprises at least two shims.

13. A lubricant metering apparatus, comprising:

a metering roll mounted for rotation on a shaft having central longitudinal axis;

a blade aligned parallel to the longitudinal axis;

means for holding the blade so that an edge of the blade is in contact with a peripheral surface of the metering roll;

means for coupling the shaft to the blade holding means;

a plurality of elastomeric seals adjacent each radial end surface of the metering roll; and means for supporting the elastomeric seals against the radial end surfaces of the metering roll so that the elastomeric seals do not rotate with the metering roll.

14. The metering apparatus of claim 13, wherein the support means includes rigid plates coupled to the elastomeric seals.

15. The metering apparatus of claim 14, wherein the support means includes means for urging the rigid plates against the elastomeric seals so that the elastomeric seals are held in sealing contact against the radial end surfaces of the metering roll.

16. The metering apparatus of claim 15, wherein the urging means comprises a plurality of springs.

17. The metering apparatus of claim 13, further comprising means, disposed at each end of the blade on the blade holding means, for urging the ends of the blade against the peripheral surface of the metering roll.

18. The metering apparatus of claim 17, wherein the blade urging means comprises at least two leaf springs.

19. The metering apparatus of claim 17, wherein the blade urging means comprises at least two L-shaped flat springs.

20. The metering apparatus of claim 17, wherein the blade urging means comprises at least two shims.

21. A lubricant metering apparatus comprising:

a cylindrical metering roll supported for rotation about a central longitudinal axis;

a blade aligned with the longitudinal axis;

means for supporting the blade so that an edge of the blade contacts a peripheral surface of the metering roll;

an elastomeric seal supported against an end of the metering roll for preventing excess lubricant from accumulating at the end of the metering roll; and a rigid plate coupled to the elastomeric seal for supporting the elastomeric seal against the end of the metering roll.

* * * * *